US006689192B1

(12) United States Patent
Phillips et al.

(10) Patent No.: US 6,689,192 B1
(45) Date of Patent: Feb. 10, 2004

(54) METHOD FOR PRODUCING METALLIC NANOPARTICLES

(75) Inventors: Jonathan Phillips, Santa Fe, NM (US); William L. Perry, Albuquerque, NM (US); William J. Kroenke, Placitas, NM (US)

(73) Assignee: The Regents of the University of California, Los Alamos, NM (US)

( * ) Notice: Subject to any disclaimer, the term of this patent is extended or adjusted under 35 U.S.C. 154(b) by 28 days.

(21) Appl. No.: 10/017,289

(22) Filed: Dec. 13, 2001

(51) Int. Cl.[7] ..... B22F 9/00

(52) U.S. Cl. ..... 75/342; 75/346; 75/10.19; 75/10.22

(58) Field of Search ..... 75/255, 346, 342, 75/10.19, 10.21, 10.22

(56) References Cited

U.S. PATENT DOCUMENTS

| | | | | |
|---|---|---|---|---|
| 3,848,068 | A | * 11/1974 | Rice | |
| 4,383,852 | A | * 5/1983 | Yoshizawa | |
| 4,808,217 | A | * 2/1989 | Kopatz et al. | |
| 5,364,562 | A | * 11/1994 | Wang | 252/305 |
| 5,514,350 | A | 5/1996 | Kear et al. | 422/198 |
| 5,585,020 | A | 12/1996 | Becker | 219/121 |
| 5,665,277 | A | 9/1997 | Johnson et al. | 264/6 |
| 5,783,263 | A | 7/1998 | Majetich et al. | 427/580 |
| 5,876,683 | A | 3/1999 | Glumac et al. | 423/325 |
| 5,958,329 | A | 9/1999 | Brown | 266/176 |
| 5,972,065 | A | * 10/1999 | Dunn et al. | |
| 5,984,996 | A | 11/1999 | Gonsalves et al. | 75/246 |
| 5,989,648 | A | 11/1999 | Phillips | 427/456 |
| 6,165,247 | A | * 12/2000 | Kodas et al. | 75/331 |
| 6,254,940 | B1 | 7/2001 | Pratsinis | 427/562 |

OTHER PUBLICATIONS

C. Hao et al., "Plasma Production of Metallic Nanoparticles," J. Mater. Res., 1992, vol. 7, No. 8, pp. 2107–2113.

C. G. Graqvist et al., "Ultrafine Metal Particles," J. Applied Physics, May 1976, vol. 47, 1976, No. 5, pp. 2200–2219.

S. Panda et al., "Modeling the Synthesis of Aluminum Particles by Evaporation–Condensation in an Aersol Flow Reactor," Nanostructed Mater., 1995, vol. 5, No. 7/8, pp. 755–767.

D. Vollath et al., "Synthesis of Nanosized Ceramic Nitride Powders by Microwave Supported Plasma Reactions," Nanostructed Mater., 1993, vol. 2, pp. 451–456.

D. Vollath et al., "Synthesis of Nanosized Ceramic Oxide Powders by Microwave Plasma Reactions," Nanostructed Mater., 1992, vol. 1, pp. 427–437.

J. R. Brenner et al., "Microwave Plasma Synthesis of Carbon–Supported Ultrafine Metal Particles," Nanostructed Mater., 1997, vol. 8, No. 1, pp. 1–17.

S. Iwama et al., "Vaporization and Condensation of Metals in a Flowing Gas With High Velocity," Nanostructed Mater., 1992, vol. 1, pp. 113–118.

H. J. Fecht, "Synthesis and Properties of Nanocrystalline Metals and Alloys Prepared by Mechanical Attrition," Nanostructed Mater., 1992, vol. 1, pp. 125–130.

(List continued on next page.)

*Primary Examiner*—Ngoclan Mai
(74) *Attorney, Agent, or Firm*—Samuel L. Borkowsky

(57) ABSTRACT

Method for producing metallic nanoparticles. The method includes generating an aerosol of solid metallic microparticles, generating non-oxidizing plasma with a plasma hot zone at a temperature sufficiently high to vaporize the microparticles into metal vapor, and directing the aerosol into the hot zone of the plasma. The microparticles vaporize in the hot zone to metal vapor. The metal vapor is directed away from the hot zone and to the plasma afterglow where it cools and condenses to form solid metallic nanoparticles.

19 Claims, 5 Drawing Sheets

OTHER PUBLICATIONS

V. Haas et al., "The Morphology and Size of Nanostructed Cu, Pd, and W Generated by Sputtering," Nanostructed Mater., 1992, vol. 1, pp. 491–504.

P. J. Herley et al., "Nanoparticle Generation by Electron Beam Induced Atomization of Binary Metal Azides," Nanostructed Mater., 1993, vol. 2, pp. 553–562.

K. Recknagle et al., "Properties of Nanocrystalline Zinc Produced by Gas Condensation," Nanostructed Mater., 1994, vol. 4, No. 1, pp. 103–111.

T. Yamamoto et al., "Synthesis of Nanocrystalline $NbAl_3$ by Laser Ablation Technique," Nanostructed Mater., 1996, vol. 7, No. 3, pp. 305–312.

G. Yang et al., "Characterization and Sinterability of Nanophase Titania Particles Processed in Flame Reactors," Nanostructured Mater., 1996, vol. 7, No. 6, pp. 675–689.

J. A. Eastman et al., Synthesis of Nanophase Materials by Electron Beam Evaporation, Nanostructured Mater., 1993, vol. 2, pp. 377–382.

J. P. Chen et al., "Enhanced Magnetization of Nanoscale Colloidal Particles," Phys. Rev. B, May 1995, vol. 51, No. 17, pp. 11527–11532.

W. Gong et al., "Ultrafine Particles of Fe, Co, and Ni Ferromagnetic Metals," J. Appl. Phys., Apr. 1991, vol. 69, No. 8, pp. 5119–5121.

T. Majima et al., "Preparation of Iron Ultrafine Particles by the Dielectric Breakdown of $Fe(CO)_5$ Using a Transversely Excited Atmospheric $CO_2$ Laser and Their Characteristics," Jpn. J. Appl. Phys., Aug. 1994, vol. 33, pt. 1, No. 8, pp. 4759–4763.

Y. Sawada et al., "Synthesis and Magnetic Properties of Ultrafine Iron Particles Prepared by Pyrolysis of Carbonyl Iron," Jpn. J. Appl. Phys., Dec. 1992, vol. 31, pt. 1, No. 12A, pp. 3858–3861.

A. Chatterjee et al., "Preparation of Nickel Nanoparticles by Metalorganic Route," Appl. Phys. Lett., Jan. 1992, vol. 60, No. 1, pp. 138–140.

Josep Costa, "Nanoparticles From Low–Pressure, LowTemperature Plasmas," Chapter 2, Handbook of Nanostructured Materials and Nanotechnology, H. S. Nalwa, ed., vol. 1, 2000, pp. 57–158.

Chun–Ki Chen, "Low–power Plasma Torch Method for the Production of Crystalline Spherical Creamic Particles," J. Mater. Res., vol. 16 No. 5, May 2001, pp. 1256–1265.

H. Shim and J. Phillips, "Restructuring of Alumina Particles Using a Plasma Torch," J. Mater. Res., vol. 14, No. 3, Mar. 1999, pp. 849–854.

* cited by examiner

METHOD FOR PRODUCING METALLIC NANOPARTICLES

STATEMENT REGARDING FEDERAL RIGHTS

This invention was made with government support under Contract No. W-5 7405-ENG-36 awarded by the U.S. Department of Energy. The government has certain rights in the invention.

FIELD OF THE INVENTION

The present invention relates generally to metallic nanoparticles and, more particularly, to a plasma-based method of producing uniform, spherical, metallic nanoparticles.

BACKGROUND OF THE INVENTION

Metallic nanoparticles, and in particular uniform, spherical, metallic nanoparticles having a diameter of about 1–100 nanometers (nm) (see, for example, C. G. Grandqvist and R. A. Buhrman in "Ultrafine Metal Particles", J. Appl. Phys. Vol. 47, no. 5, pp. 2200–2219, 1976) are important materials for applications that include semiconductor technology, magnetic storage, electronics fabrication, and catalysis. Metallic nanoparticles have been produced by gas evaporation (see K. Kimoto et al. in J. Appl. Phys. Vol. 2, p. 702, 1963; and W. Gong et al., J. Appl. Phys., vol. 69, no. 8, pp. 5119–5121); by evaporation in a flowing gas stream (see S. Iwama et al., Nanostructured Materials, vol 1, pp 113–118, 1992; and S. Panda et al., Nanostructured Materials, vol. 5, nos. 7/8, pp. 755–767, 1995); by mechanical attrition (see H. J. Fecht et al., Nanostructured Materials, vol. 1, pp. 125–130, 1992); by sputtering (see V. Haas et al., Nanostructured Materials, vol. 1, pp. 491–504, 1002); by electron beam 25 evaporation (see J. A. Eastman et al., Nanostructured Materials, vol. 2, pp. 377–382, 1993); by electron beam induced atomization of binary metal azides (see P. J. Herley et al., Nanostructured Materials, vol. 2, pp. 553–562, 1993); by expansion of metal vapor in a supersonic free jet (see K. Recknagle et al., Nanostructured Materials, vol. 4, pp. 103–111, 1994); by inverse micelle techniques (see J. P. Chen et al., Physical Review B, vol. 51, no. 17, pp. 527–532); by laser ablation (see T. Yamamoto et al., Nanostructured Materials, vol. 7, no. 3, pp. 305–312, 1996); by laser-induced breakdown of organometallic compounds (see T. Majima et al., Jpn. J. Appl. Phys., vol. 33, pp. 4759–4763, 1994); by pyrolysis of organometallic compounds (see Y. Sawada et al., Jpn. J. Appl. Phys., vol 31, pp. 3858, 1992); by microwave plasma decomposition of. organometallic compounds (see C. Chou et. al, J. Mat. Res., vol. 7, no. 8, pp. 2107–2113, 1992; and J. R. Brenner et al., Nanostructured Materials, vol. 8, no. 1, pp. 1–17, 1997, and by other methods.

Preferred methods provide a pure metallic nanoparticle product, and are to continuous, i.e. production is not halted to replenish the supply of reactants after depletion. Preferred methods, also, are cost effective, employ relatively inexpensive precursor materials, and are scalable from a laboratory scale to an industrial scale. At least some of these criteria for a preferred method pertain to some of the above methods. However, none of the above methods has been scaled up from a laboratory scale to a larger, industrial scale. Thus, cost-effective, continuous methods for producing uniform, high purity, metallic nanoparticles on a large scale remain desirable.

Therefore, an object of the present invention is to provide a method for producing uniform, high purity, metallic nanoparticles.

Another object of the present invention is to provide a continuous method for producing metallic nanoparticles.

Another object of the present invention is to provide an energy-efficient method for producing metallic nanoparticles.

Another object of the present invention is to provide a cost-effective method for producing metallic nanoparticles from inexpensive precursor materials.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes a method for producing metal nanoparticles. The method includes generating an aerosol having solid metal microparticles and generating a non-oxidizing plasma with a plasma hot zone at a temperature sufficiently high to vaporize the microparticles into metal vapor. The aerosol is directed into the plasma hot zone so that the microparticles vaporize, and the metal vapor is directed away from the plasma and allowed to cool, condense, and form solid metal nanoparticles.

The invention also includes metallic nanoparticles that are made by generating an aerosol having microparticles and generating a non-oxidizing plasma with a plasma hot zone at a temperature sufficiently high to vaporize the microparticles into metal vapor. The aerosol is directed into the plasma hot zone so that the microparticles vaporize, and the metal vapor is directed away from the plasma and allowed to cool, condense, and form solid metal nanoparticles.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION OF THE INVENTION

Figure 1:
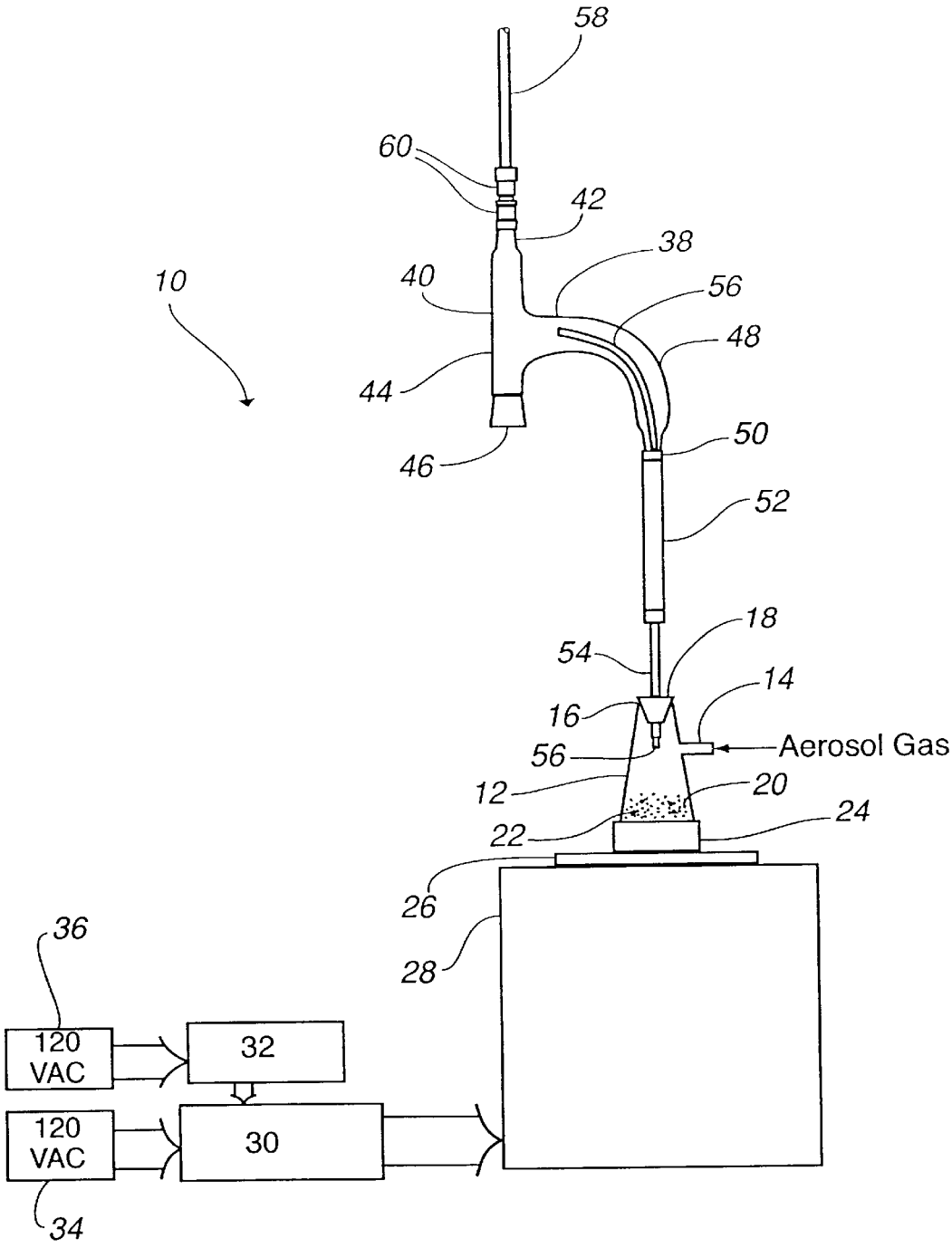
FIG. 1 shows a schematic representation of a particle feeder that produces a metallic microparticle aerosol and delivers it to a plasma torch.

The invention includes a continuous method for producing metallic nanoparticles from microparticles, i.e. micron-scale sized precursor metallic particles. The method involves generating an aerosol of the precursor metallic microparticles, generating a non-oxidizing plasma, and directing the precursor metallic microparticles through the non-oxidizing plasma. As the microparticles flow through the plasma "hot zone", i.e. the hottest portion of the plasma, the microparticles vaporize into metal vapor. As the metal vapor exits the hot zone and enters the "afterglow region" (i.e. the area beyond the coupler in which no energy is supplied to the vapor), the vapor rapidly cools. As the vapor cools, nucleation and growth processes such as Ostwald ripening and agglomeration occur, which lead to the formation of metallic nanoparticles.

The method of the invention was demonstrated by converting aluminum microparticles into solid, spherical, aluminum nanoparticles. The aluminum microparticles were generated by wet-ball milling oxide-coated aluminum microparticles having a diameter of about 1–100 microns in diameter with an average diameter of about 40 micrometers. A plasma torch apparatus was used to generate a low power, atmospheric pressure, argon, microwave plasma, and an aerosol of the milled aluminum microparticles was directed through the plasma. The aluminum microparticles vaporized as they flowed through the hot zone of the plasma. As the metal vapor exited the hot zone and entered the afterglow of the plasma, the metal vapor cooled, condensed, and formed solid, spherical, aluminum nanoparticles.

The plasma torch apparatus has been described previously (see, for example: H. Shim et al., "Restructuring of Alumina particles Using a Plasma Torch", J. Mat. Res., volume 14, page 849 (1999); C-K Chen et al. J. Mat. Res., vol. 16, p. 1256, (2001); U.S. Pat. No. 5,989,648 to J. Phillips entitled "Plasma Generation of Supported Metal Catalysts," issued on Nov. 23, 1999; and U.S. patent application Ser. No. 09/637,172, to Phillips et al., all incorporated by reference herein). Briefly, the plasma torch included an Astex magnetron (Woburn, Mass.) that generated 2.54 GHz microwaves. The microwaves were transmitted to the plasma region using a standard WR-289 waveguide in the TE10 mode. A three-stub tuner transferred nearly 100% of the microwave power (<1.5 kW) from the magnetron to plasma gas that passed through a quartz, 19-mm outer diameter, plasma tube at the 'coupler' end of the waveguide.

The plasma torch generates extreme axial temperature gradients that vaporize the precursor microparticles over a wide range of residence times. Microwave energy is absorbed by both the microparticles and by the plasma gas that transports the microparticles to the plasma. The absorption of energy creates a stationary plasma discharge. Its high specific power (PN) dissipation promotes high rates of both heating and cooling. While the hot zone of the plasma is at a high temperature (about 4000 K), the cooling rate is very rapid for plasma gas and metal vapor exiting the hot zone; within about 0.2 seconds of leaving the hot zone, the plasma gas cools to nearly room temperature.

Three separately controlled argon gas flows were fed through the plasma torch. The first gas flow, referred to herein as the "injector flow", proceeded at a rate of about 0.63 liters per minute (lpm) and carried the precursor microparticles as an aerosol. The second gas flow, referred to herein as the "diluent flow", proceeded at a rate of about 0.3–0.63 lpm and diluted the injector flow to provide control of the precursor particle density, i.e. # particles/cc, that was directed into the plasma torch. The injector flow and the diluent flow were joined below the torch and directed to approximately the center of the plasma through a 3-mm inner diameter (ID) alumina tube. The third flow, referred to herein as the "plasma gas flow", proceeded at a rate of about 0.3–0.63 lpm and flowed around the outside of the central alumina tube. This gas flow arrangement was used to independently control the particle density, the particle feed rate, and the total residence time in the plasma. The total system gas pressure was about 640 Torr.

The changes in the location of the terminal end of the central aluminum tube carrying the aerosol of the precursor to the plasma affect the residence time of the plasma. The terminal end of the tube was positioned nearly at the bottom of the coupler, which placed the particle injection point in a relatively cool region of the plasma, upstream from the hottest zone of the plasma. This arrangement allowed for a long residence time for particles in the hot zonie. The injector could have been located at any height, even in the afterglow of the plasma.

Nucleation and growth of the solid nanometer sized product particles likely occurs via nucleation, Ostwald ripening, and agglomeration; in the post coupler, afterglow region. The afterglow region was surrounded by a 5-cm diameter, 20-cm tall Pyrex chimney, which led to a filter and/or trap from which the product nanoparticles were collected. The nanoparticles recovered were likely covered with a very thin passivating oxide layer. Physical and specific evidence indicated that the nanoparticles were substantially aluminum metal. First, the nanoparticles were metallic grey in color as opposed to white, the color of aluminum oxide particles. Second, selected area diffraction data of single particles performed in the TEM showed only the presence of aluminum metal. Third, data collected during x-ray diffraction indicated only the presence of a metallic phase. Fourth, photoelectron spectra indicated a very weak signal for oxygen, less than expected from an aluminum oxide particle, which further substantiated that the nanoparticles were likely at least 90 atomic percent aluminum.

The initial particle size distribution was determined using a scanning electron microscope (SEM, Hitachi S-800) and software (S. Barrett, Image SXM). Final particle size distribution was determined using a transmission electron microscope and the same software.

Figure 2:
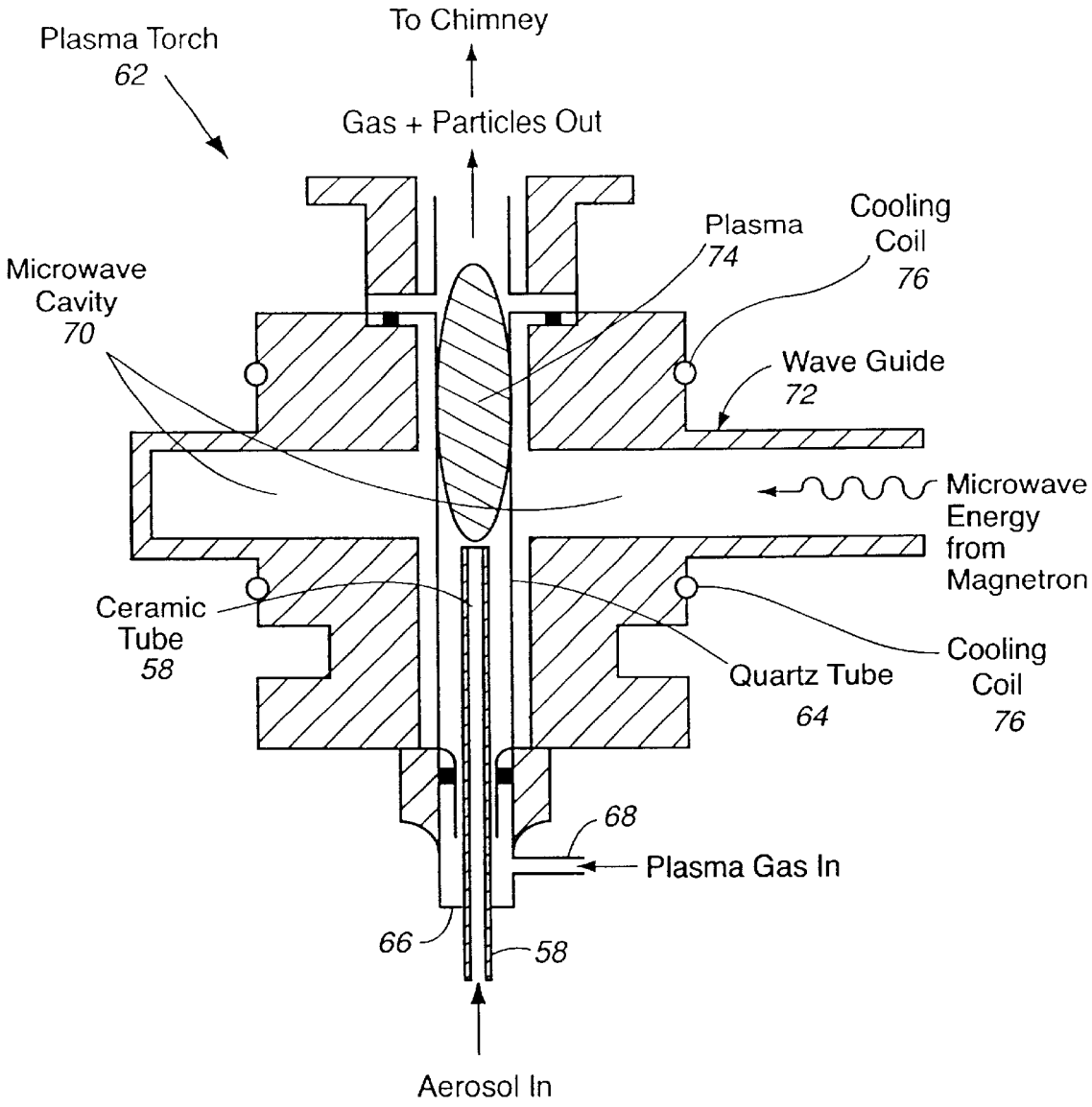
FIG. 2 shows a schematic, cross-sectional representation of a microwave plasma torch.
Figure 3:
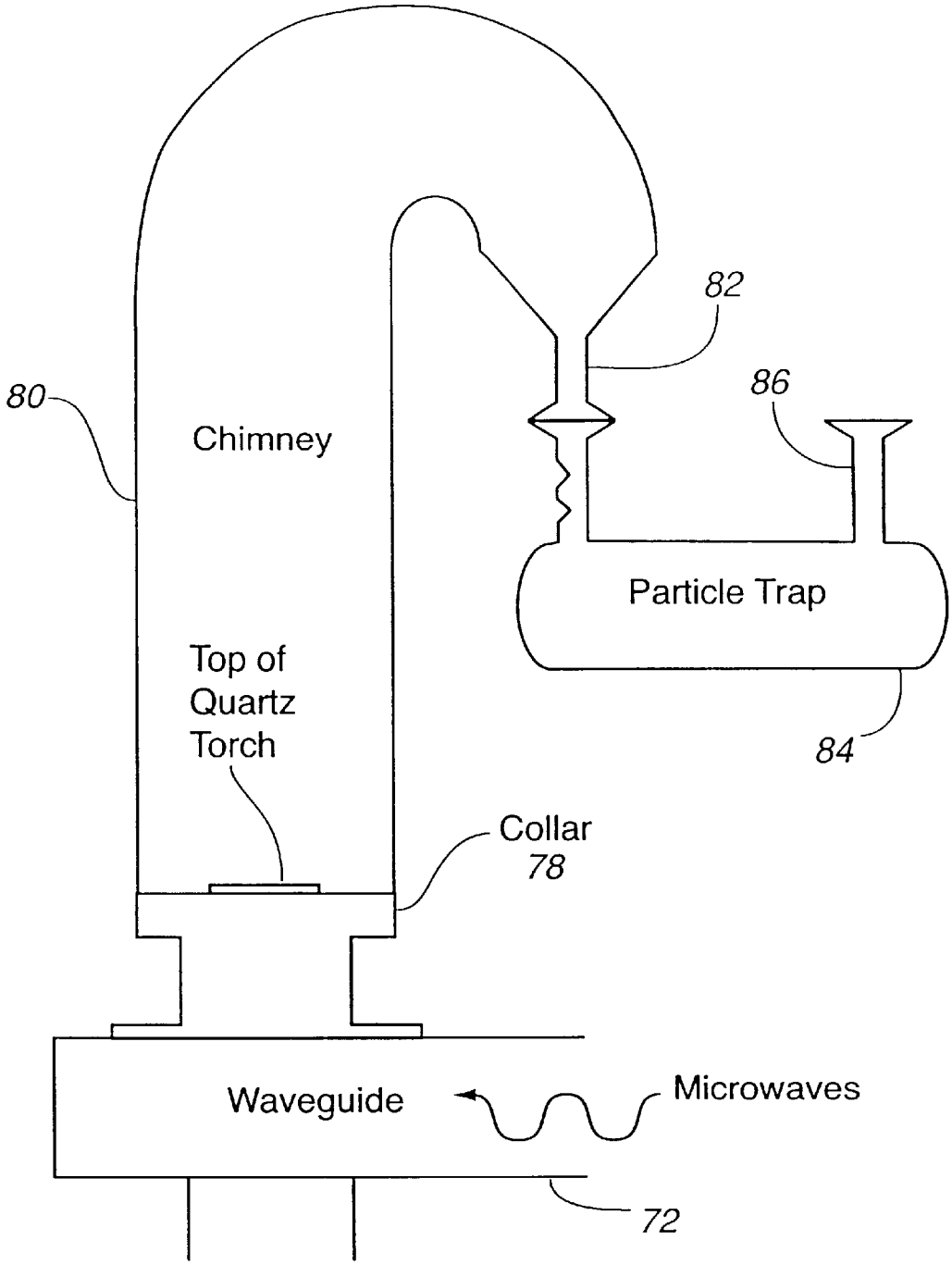
FIG. 3 shows a schematic representation of a nanoparticle collector.

The practice of the invention can be further understood with the accompanying figures. Similar or identical structure is identified using identical callouts. Turning now to the figures, the apparatus used to produce metallic nanoparticles is shown in FIGS. 1–3. FIG. 1 shows particle feeder 10. It should be understood that the main purpose of a particle feeder is to provide a metallic microparticle aerosol and to deliver the microparticlel aerosol at a controlled rate to a plasma, and that any particle feeder capable of doing this may be used. Examples of particle feeders that have been adapted for plasma torches can be found in aforementioned H. Shim et al., "Restructuring of Alumina Particles Using a Plasma Torch," J. Mat. Res., vol.14, p. 849, 1999; C-K Chen et al., J. Mat. Res., vol. 16, p. 1256, 2001; and U.S. Pat. No. 5,989,648 to J. Phillips entitled "Plasma Generation of Supported Metal Catalysts," which issued Nov. 23, 1999. An inexpensive particle feeder was constructed using parts commonly found in a laboratory. Particle feeder 10 includes particle reservoir 12 with aerosol gas inlet 14 and aerosol gas outlet 16. Outlet 16 is partially blocked with one-hole stopper 18. Reservoir 12 contains aluminum microparticles 20 and dispersing agents 22. Dispersing agents 22 are larger and heavier than microparticles 20 and are included in the reservoir for the purposes of dispersing the microparticles and removing any that adheres to the inner walls of the reservoir. Dispersing agents 22 in the form of cross-disks can be made by cutting along the radii of small (ca. 10 millimeters (mm) in diameter) aluminum disks and then interconnecting pairs of disks to form cross-disks. Reservoir 12 rests atop and is fastened to dish 24, which rests atop diaphragm 26. Diaphragm 26 is attached to diaphragm support 28. In practice, an audio speaker provided diaphragm 26 and a ported speaker box provided support 28. Diaphragm 26 can be made to oscillate vertically using audio amplifier 30, which amplifies a signal generated by signal generator 32. Amplifier 30 and signal generator 32 were powered by power sources 34 and 36 respectively.

Particle feeder 10 also includes particle trap 38 positioned above and in alignment with reservoir 12. Trap 38 has an inverted y-shape with an inline tubular portion 40 having an upper opening 42 and a lower opening 44. Removable sealing member 46 seals lower opening 44. Trap 38 also includes side tubular portion 48 attached to a side of and in fluid communication with inline tubular portion 40. Side tubular portion 48 curves downward so that the open end 50 of side tubular portion 48 is in alignment and substantially coaxial with the hole in the one hole stopper 18. Particle feeder 10 also includes a flexible tube 52 and a more rigid outer support tube 54. The upper end of tube 52 engages and seals to open end 50 of side tube portion 48. The lower end of flexible tube 52 seals to the upper end of outer support tube 54. The lower end of support tube 54 is inserted through the hole in one-hole stopper 18 and is in compressive engagement with the stopper. Particle feeder 10 also includes a flexible inner flow tube 56. Flow tube 56 is supported by support tube 54 and extends within particle feeder 10 from reservoir 12 through support tube 54 and through side tube portion 48 until almost reaching inline tube portion 40. Flow tube 56 directs aerosol out of the reservoir to inline portion 40, and also performs a particle size separator function by not permitting dispersing agents and microparticles larger than the inner diameter of the flow tube to enter the flow tube. Particle feeder 10 may also include a particle inlet (not shown) for introducing fresh microparticles as they are being removed from the reservoir and subsequently converted into nanoparticles to improve production efficiency.

Particle feeder 10 also includes a ceramic tube 58. The lower end of ceramic tube 58 is connected to the upper end 42 of inline portion 40 of particle trap 38 with connector 60. The upper end of ceramic tube 58 is directed toward the plasma generated by plasma torch 62, a schematic cross-sectional representation of which is shown in FIG. 2.

Turning now to FIG. 2, ceramic tube 58 passes through coaxial outer quartz tube 64 and seals against the lower end 66 of quartz tube 64. A non-aerosol-containing stream of plasma gas enters lower end 66 of quartz tube 64 through inlet 68. The upper end of ceramic tube 58 extends into microwave cavity 70, where the aerosol stream and plasma gas stream converge. Microwave energy generated by a magetron (not shown) is directed through waveguide 72 into microwave cavity 70 where it interacts with the combined gas streams inside cavity 70 and transforms the gas into plasma 74. Cooling coils 76 surrounding torch 62 are provided with flowing cooling water to remove excess heat from the torch.

In practice, argon plasma gas is ignited by microwave energy to form a non-oxidizing plasma. Reservoir 12, shown in FIG. 1, is made to oscillate vertically according to, for example, a sine waveform of predetermined frequency and amplitude. As reservoir 12 oscillates vertically, microparticles 20 disperse and take on a cloudy appearance inside reservoir 12 while dispersing agents 22 aid in preventing them from adhering to each other and to the inner walls of reservoir 12. Aerosol gas enters particle reservoir 12 through inlet 14 and combines with the microparticles inside to produce a microparticle aerosol that flows out of reservoir 12 through flow tube 56. Microparticles exit flow tube 56 and enter inline portion 40 of particle trap 38. Some of the heavier particles fall toward stopper 46 where they are later removed. Most particles are carried with the aerosol gas upward and out of particle trap through ceramic tube 58 to plasma torch 62, where they continue to flow upward and through plasma 74. The aerosol is directed into the plasma hot zone. The hot zone is at a temperature sufficiently high to vaporize the microparticles into metal vapor. The microparticles vaporize in the hot zone into metal vapor, which is directed away from the plasma and allowed to cool, condense, and form metal nanoparticles. After leaving the plasma, metal in some form (atoms, molten nanoparticles, solid nanoparticles, etc.) flows through collar 78, shown in FIG. 3, through chimney 80, through connecting tube 82, and into particle trap 84 where product metallic nanoparticles are collected. Plasma gas is vented out of particle trap 84 through exit port 86.

Cooling water at about 5–10° C. was circulated throughout the plasma torch system so that the system could be operated continuously without overheating. Also, a gas handling system was employed to vent the plasma exhaust gas. Nanoparticle recovery improved when a liquid such as ethanol was used as a trapping medium.

The Table shown below includes a summary of data for four samples of aluminum nanoparticles that were produced using the method of the invention. Each sample was produced using a different set of processing parameters. The mean particle diameter in nanometers was obtained for each sample by measuring the particle diameters for over 250 particles and calculating the mean, average, diameter.

TABLE

| Sample | Power (Watts) | Aerosol Flow Rate (lit/min) | Diluent Flow Rate (lit/min) | Plasma Gas Flow (lit/min) | Mean Particle Diameter (nm) |
|---|---|---|---|---|---|
| 1 | 900 | 0.63 | 0.63 | 0.3 | 45 +/− 2 |
| 2 | 700 | 0.63 | 0.3 | 0.63 | 54 +/− 3 |
| 3 | 700 | 0.63 | 0.3 | 0.63 | 34 +/− 3 |
| 4 | 700 | 0.63 | 0.63 | 0.3 | 52 +/− 4 |

As Table shows, sample 1, for example, produced nanoparticles having a mean particle diameter of 45 nanometers, +/−2 nanometers, when 900 Watts of microwave power was employed. A decrease in the microwave power to 700 Watts resulted in the production of nanoparticles having a larger mean diameter, i.e. 54 nanometers, +/−3 nanometers. However, another run under the same conditions of power, aerosol flow rate, and plasma gas flow rate, the mean particle diameter decreased to 34 nanometers. Finally, for sample 4, the mean particle diameter increased to 52 nanometers when the dilutent flow rate was increased from 0.3 lit/min (sample 3) to 0.63 lit/min (sample 4). From the data of the Table, it does not appear that small changes in microwave power, aerosol flow rate, dilutent flow rate, and plasma gas flow have a significant effect on the mean particle diameter of the nanoparticles.

Figure 4:
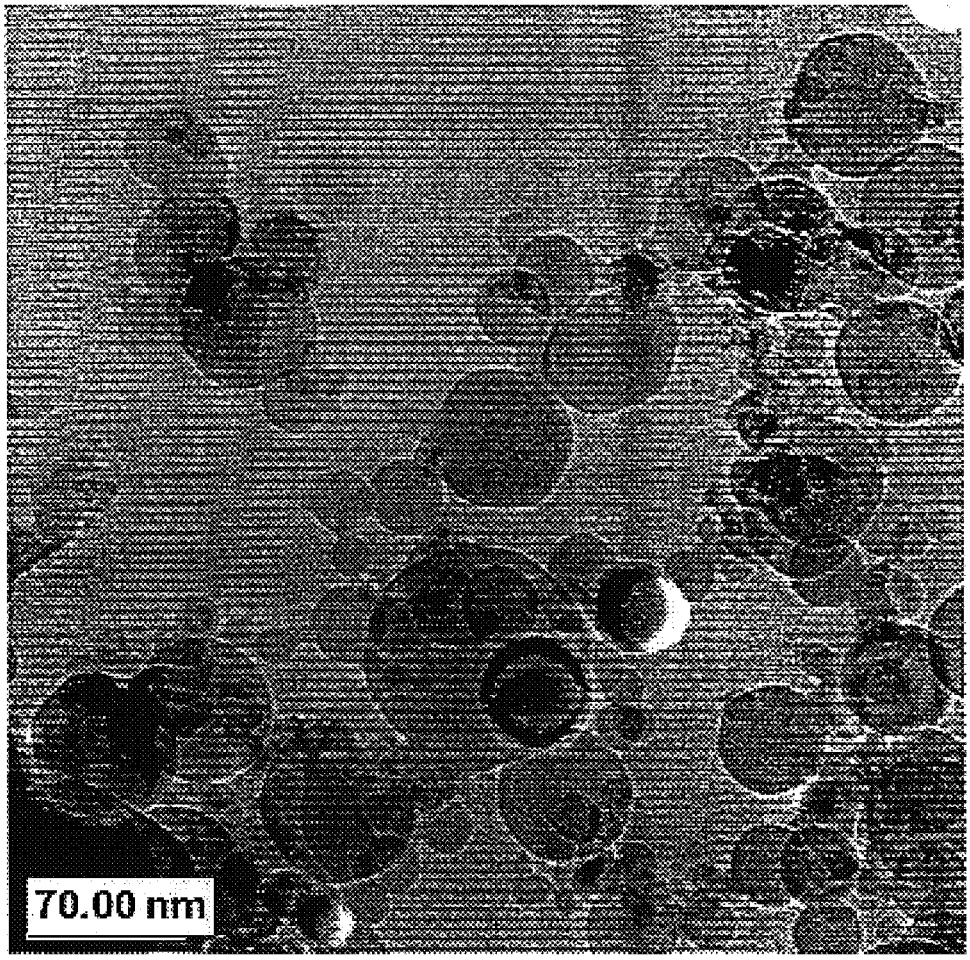
FIG. 4 shows a scanning electron photomicrograph of aluminum nanoparticles produced using the method of the invention.

FIG. 4 shows a micrograph of the aluminum nanoparticle product. All of the particles shown in FIG. 4 have a diameter less than 1 micron, and most have a diameter less than 70 nm. All of the particles are spherical, or nearly so.

Figure 5:
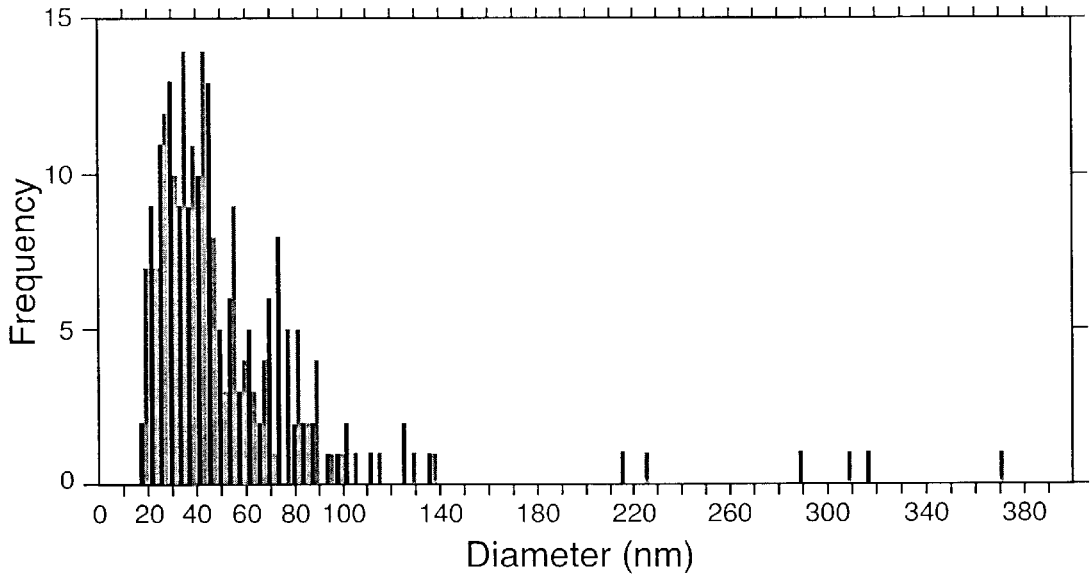
FIG. 5 shows a histogram of a particle size distribution for a batch of nanoparticles produced using the method of the invention.

FIG. 5 shows a histogram of particle size distribution, i.e. particle frequency as a function of particle diameter, for sample 2. The nanoparticles produced from sample 2 had an average volume of 395.6 $\mu m^3$. The shape of the particle size distribution obtained for samples 1, 3, and 4 were very similar to that for sample 2. Thus, nanoparticle samples 1–4 all appeared to have a nearly log normal distribution with a non-dimensional, geometric standard deviation of about 1.1–1.6, similar average particle sizes, and similar distribution width.

While the particle size distribution for the precursor microparticles was relatively wide (about 1–100 $\mu$m in diameter), the particle size distribution for the product nanoparticles was relatively narrow. All product nanoparticles had a particle diameter of less than 500 nanometers and most have a diameter less than about 100 nanometers.

While the above example illustrates the production of aluminum nanoparticles, it should be understood that nanoparticles of any solid metal can also be produced using the method of the invention. Thus, metals that can be used include the alkali metals Li, Na, K, Rb, Cs, Fr; the alkali earth metals Be, Mg, Ca, Sr, Ba, and Ra; the transition metals Sc, Ti, V, Cr, Mn, Fe, Co, Ni, Cu, Zn, Y, Zr, Nb, Mo, Tc, Ru, Rh, Pd, Ag, Qd, La, Hf, Ta, W, Re, Os, Ir, Pt, and Au; metals of the lanthanide series of metals; metals of the actinide series of metals; and post-transition metals that include Al, Ga, In, Si, Ge, Pb, Sb, Te, and Bi.

The invention may convert highly irregularly shaped metal particles into smaller, uniform, spherical particles. This indicates that the method likely involves vaporization of the precursor microparticles followed by nucleation and growth to form spherical nanoparticles. The vaporization of the microparticles can be understood by a consideration of the thermodynamics. A metallic particle is vaporized, i.e. converted to a vapor of metal atoms, when the total energy transferred to the particle exceeds the sum of the following energies: the energy required to raise the temperature of the particle to its melting temperature; the latent heat of fusion of the particle; the energy required to heat the molten particle to its vaporization temperature; and the latent heat of vaporization. These energies were supplied by convection from the hot plasma gas in the field region and by direct dissipation of microwave energy in the (conductive) particle itself.

Upon entering the afterglow region, metal atoms cool by rapidly losing energy via radiation and convection. As they cool, the atoms interact to form particles. The size and shape of the particles formed this way vary according to the type of the metal, the density of the metal gas, and the rate of cooling. Metal atoms agglomerate to form metallic nuclei, which grow to a stable size; growth is a function of metal atom density present in the portion of the cooling zone having a temperature slightly below the vaporization temperature. Growth is also a function on any electrical charge that the nanoparticles may have. Subsequent growth is a function of temperature profile downstream from this point. There is less opportunity for agglomeration and other forms of growth as cooling increases, or as the electric charge on the nanoparticles increases. Both effects account for the small product particle size. Also, the higher the density of metal atoms, the more collisions between metal atoms and thus the more rapid the growth of particles.

The product nanoparticle sizes varied slightly according to the applied microwave power. About 50–30,000 Watts of microwave power can be used. Preferably, about 300–1200 Watts of applied microwave power was used to form and maintain the microwave plasma. It should also be understood that while the description throughout refers to the use of microwave-genetated argon plasma, it is expected that other plasma systems can also be used. High pressure, i.e. greater than about 100 torr, plasma systems generated using other plasma generating means such as radiofrequency radiation and DC, for example, should be capable of producing plasmas that can be used with the method of the invention.

Inert gases such as He, Ne, Ar, and Xe, to name a few, can be used as plasma gases to generate a plasma that will be non-oxidizing with all metals. Nitrogen gas can be used to generate plasmas that should be non-oxidizing with most metals. Even oxygen gas or the halogen gases can be used to form a non-oxidizing plasma for the appropriate choice of metals. Noble metals such as Pt, for example, are especially resistant to oxidation, and nanoparticles of metals that are especially resistant to oxidation could form using an oxygen plasma (a paper describing the formation of Pt particles from Pt foil using oxygen plasma is described by C. H. Chou et al. in "Platinum Metal Etching in a Microwave Oxygen Plasma", J. Appl. Phys., vol. 68, no. 5, pp. 2415–2423, (1990).)

Microwave energy sustains a high-pressure plasma discharge by accelerating free electrons that transfer kinetic energy to gas molecules. This heats the gas molecules and promotes ionization, which produces more free electrons. The plasma torch generates two plasma regions due to the convective gas flow. The 'field region' is the region surrounded by the coupler (about 5 cm high) where the microwave electric field heats the free electrons. The field also heats conduction electrons in any entrained metal particles such that energy dissipates volumetrically by resistive heating. After the gas leaves the coupler zone, it enters the 'afterglow' region. Little or no energy transfer to the plasma gas or entrained particles takes place in this region. Thus, the gas/particle mixture cools with extreme rapidity. After a few centimeters of travel, the elections and ions recombine and the plasma no longer exists.

It is believed that several important properties of plasmas make them ideal for the formation of metallic nanoparticles from larger metallic particles. Firstly, an extremely high temperature can exist in the field region of high-pressure plasmas. As the particles traverse the field region, the conduction electrons present in the metallic particles can absorb energy directly from the plasma and the temperature is high enough to fully ablate/vaporize metals with the highest of melting temperatures. The rotation/translation temperature:of the gas at the entry to the afterglow (about 2 centimeters beyond the exit from the coupler) has been determined, using light emission spectroscopy, to exceed 3300 K. This temperature is higher than the melting temperature for most metals. Thus, it is likely that the gas temperature in the coupler is even higher than 3300 K, and that an even higher temperature may be attained for a greater level of absorbed power. The high temperature creates a driving force for convective energy transfer for rapid particle heating. Secondly, large axial temperature gradients assure that gas and entrained microparticles vaporize rapidly in a short residence time, and cooling condensation occurs extremely fast in the afterglow so that particles do not have sufficient time to grow and become larger than nanoparticles. Thirdly, direct absorption represents an independent energy transfer mechanism that can dramatically increase the energy efficiency of the invention.

The microwave power, the total gas pressure, and flow rate should affect the heating rate of the precursor material and the cooling rate of the molten particles. These parameters can be manipulated and should be adjustable to provide metallic nanoparticles of a desired range of sizes.

Finally, it is believed that the metallic nanoparticles of the present invention are of a higher purity than metallic nanoparticles generated by PVD, evaporation, laser ablation, and other methods because the plasma torch generates a pure metallic vapor from the aerosol precursor without contaminants that generally are present in other sources of metallic vapor. It is also believed that the rate of production of nanoparticles using the present invention is at least as high and likely higher than rates of production using other methods for producing metallic nanoparticles.

The foregoing description of the invention has been presented for purposes of illustration and description and is not intended to be exhaustive or to limit the invention to the precise form disclosed, and obviously many modifications and variations are possible in light of the above teaching. Commercially available particle feeders, for example, could be used instead of the particle feeder described herein.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for producing metal nanoparticles, comprising the steps of:

(a) generating an aerosol comprising solid metallic precursor microparticles;

(b) generating a non-oxidizing plasma with a plasma hot zone at a temperature sufficiently high to vaporize the microparticles into metal vapor;

(c) directing the aerosol into the hot zone of the plasma and allowing the microparticles to vaporize into metal vapor therein; and (d) directing the metal vapor away from the plasma hot zone to allow the vapor to condense and form solid metallic product nanoparticles therefrom.

2. The method of claim 1, wherein the precursor microparticles comprise microparticles of at least one elemental metal or alloy, said elemental metal or and alloy being selected from the group consisting of the alkali metals Li, Na, K, Rb, Cs, Fr, the alkali earth metals Be, Mg, Ca, Sr, Ba, and Ra, the transition metals Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, Pt, and Au, the lanthanide metals, the actinide metals, and post-transition metals Al, Ga, In, Si, Ge, Pb, Sb, Te, Bi, and alloys of the aforementioned elemental metals.

3. The method of claim 1, wherein the precursor microparticles comprise elemental aluminum.

4. The method of claim 1, wherein the solid metallic precursor microparticles are between about 1–1000 microns in diameter.

5. The method of claim 3, wherein the solid metallic precursor microparticles are about 1–100 microns in diameter.

6. The method of claim 1, wherein the solid metallic precursor microparticles comprise oxide-coated metallic microparticles.

7. The method of claim 1, wherein the non-oxidizing plasma comprises argon plasma, helium plasma, xenon plasma, nitrogen plasma, or mixtures thereof.

8. The method of claim 1, wherein the non-oxidizing plasma comprises oxygen plasma or halogen plasma when the solid metallic precursor microparticles comprise a noble metal.

9. The method of claim 1, where the plasma is generated from plasma gas at a gas pressure of about 0.001–100 atmospheres.

10. The method of claim 1, wherein the plasma is generated from plasma gas at a pressure of about 1 atmosphere.

11. The method of claim 1, wherein the plasma is generated by a DC discharge.

12. The method of claim 1, wherein the plasma is generated by supplying electromagnetic energy to the plasma gas.

13. The method of claim 12, wherein the plasma is generated using radiofrequency energy.

14. The method of claim 12, wherein the plasma is generated using microwave energy.

15. The method of claim 14, wherein the plasma is generated using about 50–30,000 watts of microwave power.

16. The method of claim 14, wherein the plasma is generated using about 300–1200 watts of power.

17. The method of claim 1, wherein the product nanoparticles have a diameter of about 1–500 nanometers.

18. The method of claim 1, wherein the product metallic nanoparticles have a diameter of about 1–100 nanometers.

19. The method of claim 1, wherein the solid metallic product nanoparticles comprise spherical nanoparticles.

* * * * *